United States Patent [19]

Frandsen

[11] 4,095,606

[45] Jun. 20, 1978

[54] METHOD FOR CARRYING FLEXIBLE GOODS SUCH AS TOBACCO

[75] Inventor: Warren E. Frandsen, Arlington Heights, Ill.

[73] Assignee: T & F Industries, Inc., Rolling Meadows, Ill.

[21] Appl. No.: 716,377

[22] Filed: Aug. 23, 1976

[51] Int. Cl.[2] ..... A24B 3/18

[52] U.S. Cl. ..... 131/140 R; 74/231 P; 198/689; 428/521; 526/352

[58] Field of Search ..... 198/688, 689; 206/411, 206/412, 236; 229/3.5 R; 428/500, 521; 131/15, 58–59, 60, 84, 62, 67, 69, 140 R, 140 C, 20 R, 20 A, 21 R, 149; 74/231 P; 326/352, 352.2

[56] References Cited

U.S. PATENT DOCUMENTS

| | | | |
|---|---|---|---|
| 2,367,911 | 1/1945 | Wells | 131/20 A |
| 3,340,328 | 9/1967 | Brindell et al. | 260/897 |
| 3,343,546 | 9/1967 | Detert et al. | 131/15 C |
| 3,352,308 | 11/1967 | Lindgreen | 131/15 R |
| 3,542,038 | 11/1970 | Hooper et al. | 131/149 |
| 3,776,145 | 12/1973 | Anderson et al. | 428/521 |
| 3,847,888 | 11/1974 | Baumgaertner | 526/352.2 |

FOREIGN PATENT DOCUMENTS

| | | | |
|---|---|---|---|
| 404,337 | 10/1924 | Germany | 131/21 R |
| 625,720 | 9/1961 | Italy | 131/20 A |
| 856,082 | 12/1960 | United Kingdom | 131/20 A |

*Primary Examiner*—Robert W. Michell
*Assistant Examiner*—V. Millin

[57] ABSTRACT

A carrier film composed of an ultra high molecular weight high density polyethylene is disclosed herein. The carrier film has a pair of opposed surfaces and a pair of opposed edges. The carrier film is perforated with a plurality of circular apertures. One of the opposed surfaces of the carrier film is roughened to carry a plurality of tobacco leaves to a wrapping machine. Tobacco leaves are held on the carrier strip by a vacuum and wound and stored on a spool. After a selected aging period the carrier strip is unwound from the spool and the tobacco leaves and carrier strip are sprayed with an adhesive. The carrier strip then releases the tobacco leaves adjacent a wrapping machine and is washed, dried and cooled.

3 Claims, 8 Drawing Figures

METHOD FOR CARRYING FLEXIBLE GOODS SUCH AS TOBACCO

BACKGROUND OF THE INVENTION

Historically, cigars have been manufactured by assembling a center cigar filler in an attitude of elongated tubes. The center cigar filler was then wrapped by hand in a wrapper leaf. Increasing costs of manual labor have forced cigar manufacturers to adopt machine manufacturing methods.

A conventional cigar manufacturing machine employs means which assemble the center filler of the cigar. A wrapper leaf is cut to a prescribed size and aged under controlled temperature and humidity conditions. After aging, the leaf is glued and wrapped around the center filler. A conventional wrapping machine is employed to wrap the leaves around the center filler.

Of particular importance to this method of making cigars, is that a carrier strip which is non-toxic, inert and which has a non-adherent surface is used. The non-adherent surface is particularly important since after the wrapper leaf is cut to size it is placed on the carrier strip and the leaf and carrier strip are rolled on to a spool. The spool is stored for a predetermined time under controlled temperature and humidity conditions for proper aging of the wrapper leaf. Thus, it is particularly important after storage on the film that the wrapper leaf quickly and easily release from the carrier film at the proper time.

One obvious choice for use in such a carrier film is tetrafluoroethylene fluorocarbon polymers or fluorinated ethylenepropylene resins which are manufactured by E. I. duPont deNemours & Co. under the name Teflon. However, Teflon is not acceptable to the Food and Drug Administration in this type of application. Therefore, a different material must be employed for this specialized carrier film.

What is needed then, is a carrier film composed of a material which is inert, non-toxic, non-adherent, meets pure food standards and which may easily be formed into elongated carrier strips. The material should also be economical to use and should be re-useable.

SUMMARY OF THE INVENTION

A carrier film for use with a cigar wrapping machine is herein disclosed. The carrier film is composed of an ultra high molecular weight, high density polyethylene. The carrier film is flat and has a pair of opposed surfaces. A pair of edges join the opposed surfaces. One of the opposed surfaces is roughened. The carrier film has a thickness of 0.004 inch.

The carrier film has a plurality of circular apertures formed therein. The circular apertures are arranged in three columns. The circular apertures in each of the columns are staggered so that successive rows of apertures are positioned at an acute angle with respect to the edges.

The carrier film is employed to transport and store flexible goods for human consumption such as tobacco leaves. The carrier film is particularly well adapted to be used for transporting and storing tobacco leaves. The tobacco leaves are used for cigar wrappings. The tobacco leaves can be held to the carrier film by a vacuum source positioned adjacent the circular apertures of the carrier film.

In use, cut tobacco leaves are placed on the carrier film and held thereto by a vacuum source. The tobacco leaves and carrier film are then wound together on a spool. The spool is then stored for a predetermined time in an area having controlled temperature and humidity in order to age the tobacco leaves carried on the spool.

After the aging process, the spool is then loaded on a feed section of a tobacco wrapping machine. The carrier film is unwound from the spool and a glue is sprayed on the leaves and carrier film. The leaves are removed from the carrier film and wrapped around a cigar. The empty carrier film is then washed, dried and cooled in order to be ready for its next use.

A principal object of the present invention is to provide a flexible carrier film composed of a flexible material which is inert with respect to materials carried thereon, does not impart a taste to materials carried thereon and if ingested, will not harm the smoker.

It is another object of the instant invention to provide a flexible carrier film which easily releases materials which are carried thereon.

It is another object of the instant invention to provide a flexible carrier film having a roughened abrasion restraint carrier surface which is adapted to release goods carried thereon.

It is a still further object of the present invention to provide a flexible carrier film, having a plurality of perforations formed therein to hold an article on said carrier film.

It is still another object of the instant invention to provide a method of conveniently storing and handling flexible materials such as tobacco leaves.

Other objects and uses of the instant invention will become readily apparent to one skilled in the art upon a perusal of the following specification and claims in light of the accompanying drawing.

DESCRIPTION OF THE PREFERRED EMBODIMENT

Figure 1:
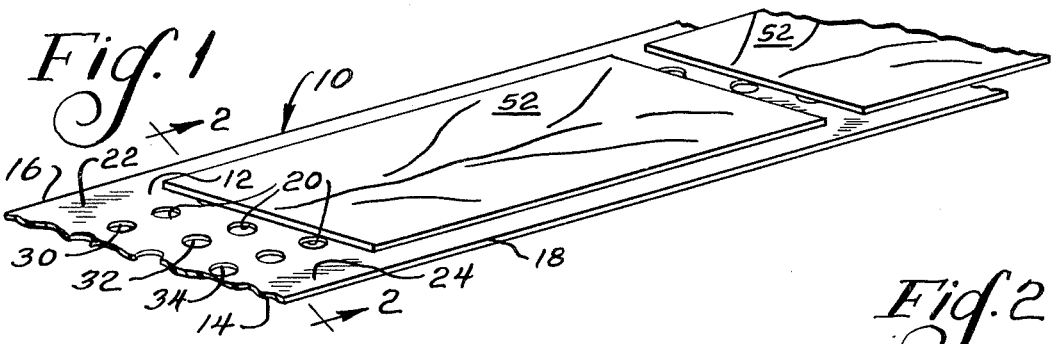
FIG. 1 is a perspective view of a carrier film embodying the instant invention, having portions broken away and having a pair of cut tobacco leaves resting thereon.
Figure 2:
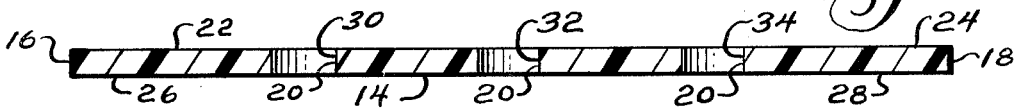
FIG. 2 is a cross-sectional view of FIG. 1, taken along line 2—2, showing details of a surface of FIG. 1.

Referring now to the drawings, and especially to FIGS. 1 and 2, a flexible carrier film embodying the instant invention and being identified by numeral 10, is shown therein. Flexible carrier film 10 has a top surface 12, a bottom surface 14 and a pair of edges 16 and 18. A plurality of apertures 20 is formed in carrier film 10.

Top surface 12 is a carrier surface. Carrier surface 12 is slightly roughened. In the present embodiment, carrier surface 12 has a width of 2.0 inches. Carrier surface 12 also has a pair of top margins, respectively numbered 22 and 24. Margins 22 and 24 are each 0.5 inches wide and abut edges 16 and 18, respectively.

Bottom surface 14 is a smooth surface, having a width of 2.0 inches. Bottom surface 14 borders edges 16 and 18, respectively. Bottom surface 14 is positioned equidistant throughout its length with surface 12. Bottom surface 14 has a pair of margins respectively numbered 26 and 28, which are positioned opposite margins 22 and 24, respectively. Each of margins 26 and 28 has a width of 0.5 inch. Margin 26 borders edge 16. Margin 28 borders edge 18. Plurality of apertures 20 is also positioned between margins 26 and 28. Top surface 12 is separated from bottom surface 14 in this embodiment by a uniform thickness of 0.004 inch. The 0.004 inch thickness maintain tensile strength while retaining flexibility. Other embodiments of the instant invention may have thicknesses ranging between 0.001 and 0.01 inch.

Edge 16 is 0.004 inch wide and is formed integral with top surface 12 and bottom surface 14, respectively. Edge 16 is also formed integral with top margin 22 and bottom margin 26.

Edge 18 is the same width as edge 16 and is formed integral with top face 12 and bottom face 14. Edge 18 is positioned equidistant from edge 16. Edge 18 is also formed integral with margins 24 and 28.

Plurality of apertures 20 is arranged in three columns, respectively numbered 30, 32 and 34. Column 30 is positioned near edge 16, column 34 is positioned near edge 24 and column 32 is positioned midway therebetween. Column 30 is positioned 0.5 inch from edge 16. Column 34 is positioned 0.5 inch from edge 18. The apertures of columns 30, 32 and 34 are positioned on film at regular intervals. The apertures of columns 30, 32 and 34 are arranged in rows. The rows, however, are not positioned perpendicular to edges 16 and 18. Rather, the rows are positioned at an acute angle with respect to edges 16 and 18. The angle is greater than 45°. The apertures are circular and have a diameter of 0.125 inch.

In this case, the material of preference is an ultra high molecular weight high density polyethylene. The polyethylene has a molecular weight between 3,000,000 and 5,000,000. Most polyethylenes which are available commercially have a molecular weight between 300,000 and 500,000. The ultra high molecular weight polyethylene is highly abrasion resistant and is non-adhesive to most materials, including tobacco leaves.

Figure 3:
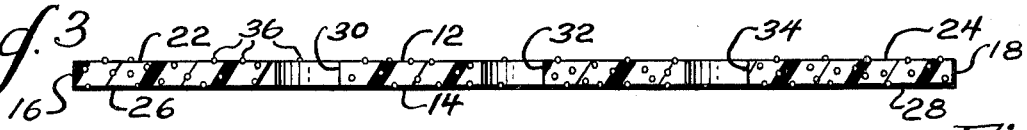
FIG. 3 is a cross-sectional view of another embodiment of the instant carrier film, showing a plurality of glass beads embedded within a plastic.

Referring now to FIG. 3, another embodiment of the instant invention can be seen therein. A plurality of glass beads generally indicated by number 36, is embedded therein. Some of the glass beads are positioned near top surface 12 and bottom surface 14. These glass beads contribute to make top surface 12 and bottom surface 14 rough surfaces. Other embodiments of the instant invention may employ silica shot instead of glass beads 36 to provide a roughened surface 12.

Figure 4:
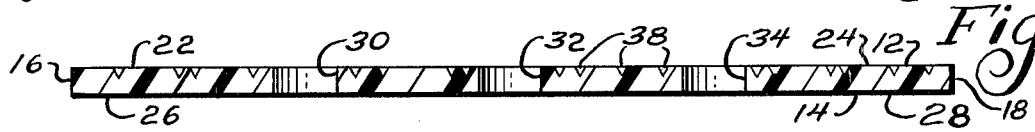
FIG. 4 is a cross-sectional view of still another embodiment of the instant invention, showing a plurality of depressed pyramidal portions on a carrier surface of the carrier film.

Still another embodiment of the instant invention is shown in FIG. 4. Top surface 12 has a plurality of pyramidal indentations 38. It should be noted that the pyramids 38 are positioned only on upper surface 12 to make upper surface 12 a rough surface.

Figure 5:
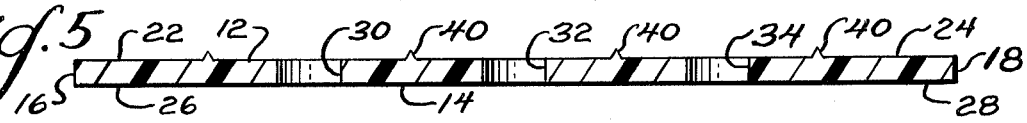
FIG. 5 is a cross-sectional view of still another embodiment of the instant invention, showing a plurality of triangular cross-section ridges positioned at uniform distances from a pair of edges of the carrier strip.

Referring now to FIG. 5, still another embodiment of the instant invention is shown therein. In this embodiment, surface 12 has a plurality of raised, elongated, triangular cross-section ridges 40. Ridges 40 run the length of carrier film 10 and are positioned at uniform distances from edges 16 and 18.

Other embodiments of the instant invention may incoporate a silicone oil additive which lowers adhesion of contact surface 12.

Figure 6:
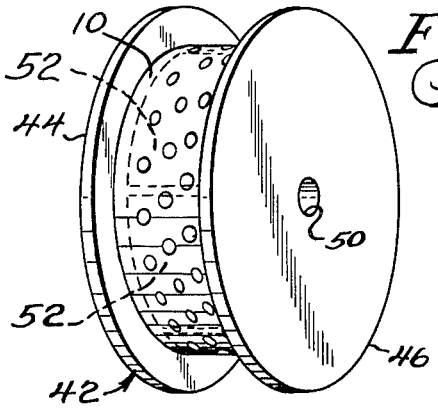
FIG. 6 is a perspective view of a spool, having the carrier film wound thereon and showing a pair of tobacco leaves in phantom view positioned on the carrier film.
Figure 7:
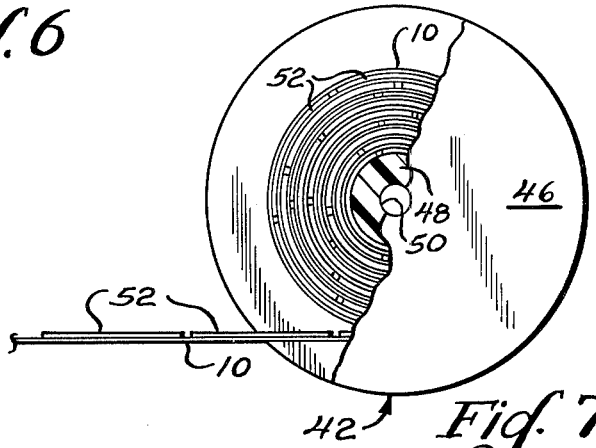
FIG. 7 is a top view of the spool of FIG. 6, having a portion broken away, showing details of the position of the wound carrier film together with a plurality of tobacco leaves carried thereon.

Referring now to FIGS. 6 and 7, a spool 42 is generally shown therein. Spool 42 has a pair of identical spool discs 44 and 46. Spool discs 44 and 46 are positioned parallel to each other and are connected by a central spool hub 48. Spool hub 48 is positioned perpendicular to spool discs 44 and 46. Spool hub 48 has a central aperture 50 formed therein. A length of carrier film 10 having a plurality of tobacco leaves, generally indicated by numeral 52, is wound on spool 42 in successive layers.

Figure 8:
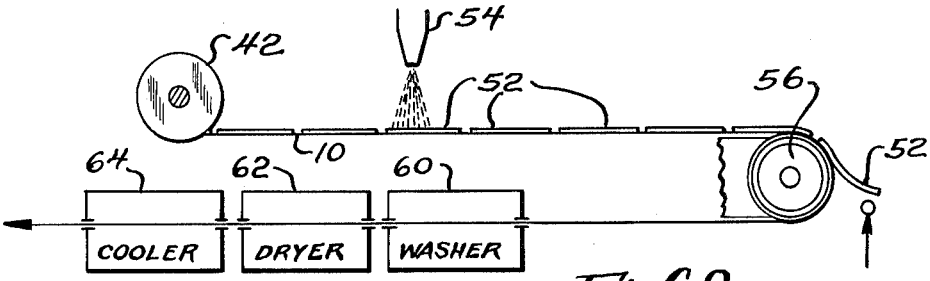
FIG. 8 is a schematic diagram of the processing of tobacco leaves held on the carrier film showing details of a method of removing the tobacco leaves from the carrier film and cleaning the carrier film after use.

Referring now to FIG. 8, a schematic diagram of a portion of a cigar wrapping machine is shown therein. Spool 42 is positioned to the left and has a section of carrier film wound therefrom. A glue sprayer 54 is positioned adjacent spool 42. Carrier film 10 is wound around a roller 56. Carrier film 10 passes through a washer 60, a hot air drier 62 and a cooler 64.

In use, tobacco leaves 52 are cut to size and the cut tobacco leaves are placed on carrier film 10 and held there by a low pressure or vacuum source positioned adjacent circular apertures 20. The leaves 52, together with carrier film 10 are then rolled on spool 42 and stored under controlled temperature and humidity conditions. After storage, the leaves 52 are ready to be wrapped around cigar fillers. The spool is then loaded on to a delivery device and flexible carrier film 10 is unrolled from spool 42. Upon being unrolled from spool 42 flexible film 10 carries leaves 52 along with it. The leaves are carried under glue sprayer 54 and are sprayed with a non-toxic glue which holds them in contact with the center filler portions of the cigars about which they are to be wrapped. The leaves are then carried along by carrier film 10 to roller 56. Roller 56 causes film 10 to execute a 180° change in direction. As the leaves are carried on carrier film 10 around roller 56, they begin to peel off. The peeling is caused by the fact that the leaves take a set when stored and the carrier film 10 flexes opposite the set at roller 56. The tobacco leaves are then wrapped around a suitable cigar center filler. Carrier film 10 is then sent through a washer 60 where it is cleaned and the glue is removed from it. The carrier film is then dried in hot air dryer 62 and cooled in cooler 64. It is particularly important that carrier film 10 is cooled in order to prevent it from taking a set or stretching unduly if rolled while warm onto a storage spool. Carrier film 10 is then either rolled on a storage spool and is ready for use once again, or is immediately reloaded with additional tobacco leaves.

Margins 22, 24, 26 and 28 prevent leaves 52 from becoming wrinkled at their edges when stored on spool 42. Margins 22, 24, 26 and 28 act as a press on the leaf edges. The apertures in columns 30, 32 and 34 are staggered to prevent transverse wrinkling of the leaves during storage, as might occur if the rows of apertures 20 were aligned perpendicular to edges 16 and 18. Prevention of leaf wrinkling is particularly important because the leaves should be affixed smoothly around the center filler after wrapping.

It should be noted that the property which is most important to carrier film 10, is its releasability of goods carried thereon. It may be appreciated that tobacco leaves 52 not only have a natural adhesion for surfaces against which they may be resting for a period of time, but also have a tendency to stick to most surfaces when glue is sprayed on them. The roughened surface 12, which can also be roughened by either glass beads 36, pyramidal indentations 38 or ridges 40 also enhances the releasability of carrier film 10 by lowering a contact area between roughened surface 12 and tobacco leaves 52. Ultra high molecular weight high density polyethylene is inert and non-toxic.

The carrier film is formed by shaving or scarving a thin section of polyethylene strip from an ultra high molecular weight polyethylene billet. Customarily, the billet is manufactured by molding ultra high molecular weight high density polyethylene into a cylinder under pressure and elevated temperature in order that the scarving may be carried out uniformly. The billet may, in addition, have added to it glass beads 36 in order that a rough surface is maintained on top surface 12 which contacts the plurality of tobacco leaves to be carried. The rough surface is important whether it is composed of glass beads, pyramidal indentations, or elongated, triangular ridges in order that the leaves release more readily. If the surface is smooth, or becomes too smooth, the leaves have less tendency to release readily. The pyramidal indentations can be impressed into the film surface after scarving. The ridges can be formed in the film surface during scarving. The carrier film is then trimmed and apertures 20 are punched in it.

It should therefore be appreciated, that the instant invention provides a flexible carrier film which is abrasion resistant and which readily releases food products, such as tobacco leaves, which are carried thereon. In addition, the carrier film may be easily manufactured by scarving sections from a rotating billet. Since the carrier film has high abrasion resistance, a rough surface impressed upon the carrier film will maintain its roughness and not smooth out under continuous use. Thus, the carrier surface retains its releasable qualities over a long period of use.

Although a specific embodiment of the herein disclosed invention has been described in detail above, it may be appreciated that those skilled in the art may make other modifications and changes in the specific carrier film disclosed above without departing from the spirit and scope of the present invention. It is to be expressly understood that the instant invention is limited only by the appended claims.

What is claimed is:

1. A method of handling flexible materials comprising: placing said flexible materials in contact with a carrier film composed of an ultra high molecular weight polyethylene having a molecular weight in excess of 3,000,000; storing said materials on said carrier film for a period of time; carrying said flexible materials on said carrier film past an adhesive spray; and releasing said materials from said carrier film by flexure of said carrier film.

2. A method of handling flexible materials as defined in claim 1, in which said flexible materials are composed of tobacco leaves.

3. A method of conditioning and handling tobacco wrapper leaves to be wrapped around a cigar center comprising the steps of: placing a plurality of elongated strips of tobacco wrapper leaf onto an elongated strip of carrier film consisting of an ultra high molecular weight polyethylene having a molecular weight in excess of 3,000,000 and said strip having a plurality of apertures contained therein, winding the carrier film with the tobacco wrapper leaf positioned on the film onto a hub, storing the wound carrier film with the tobacco wrapper leaf for a selected period of time at a selected temperature and humidity, unwinding the carrier film from the hub, removing the tobacco wrapper leaf from the unwound portion of the carrier film to deliver the tobacco wrapper leaf for wrapping onto a cigar center, and cleaning the carrier film.

* * * * *